US005755075A

United States Patent [19]

Culpepper

[11] Patent Number: 5,755,075

[45] Date of Patent: May 26, 1998

[54] FLIGHT BAR

[75] Inventor: Will L. Culpepper, Covington, Ga.

[73] Assignee: The Mead Corporation, Dayton, Ohio

[21] Appl. No.: 808,762

[22] Filed: Mar. 3, 1997

[51] Int. Cl.[6] ..... B65B 35/54

[52] U.S. Cl. ..... 53/157; 53/238; 53/540

[58] Field of Search ..... 53/48.7, 156, 157, 53/238, 251, 540, 543; 198/426, 429, 431, 432, 433, 442

[56] References Cited

U.S. PATENT DOCUMENTS

| | | | |
|---|---|---|---|
| 2,920,737 | 1/1960 | Engleson et al. | 53/251 X |
| 3,778,959 | 12/1973 | Langen et al. | 53/534 X |
| 4,237,673 | 12/1980 | Calvert et al. | 53/251 X |
| 5,437,143 | 8/1995 | Culpepper et al. | 53/157 X |
| 5,456,058 | 10/1995 | Ziegler | 53/157 X |
| 5,469,687 | 11/1995 | Olson | 53/48.7 X |
| 5,477,655 | 12/1995 | Hawley | 53/543 X |

*Primary Examiner*—Daniel Moon
*Attorney, Agent, or Firm*—Michael V. Drew

[57] ABSTRACT

A flight bar frame which translates along a predetermined path is adapted for engaging and translating an article grouping of one or more articles while simultaneously engaging and translating a sheet of material above the article grouping. The sheet of material is urged downwardly into juxtaposition above the article grouping by means of a lowering guide assembly. The flight bar frame is adapted for passage therethrough of lowering guides of the lowering guide assembly.

6 Claims, 4 Drawing Sheets

FLIGHT BAR

BACKGROUND OF THE INVENTION

The invention relates generally to packaging systems, and more particularly to packaging systems in which sheets of material are translated in synchronous motion over article groupings and ultimately urged downwardly to juxtaposition over the article groupings.

In the packaging of articles it is often desirable to place a sheet of material over an article grouping of one or more articles. An example of such an arrangement is illustrated in FIGS. 1–3 wherein an insert panel 20 separates two tiers of stacked articles, such as cans 10. An example of a package of this type, including an insert, is disclosed in U.S. Pat. No. 5,518,111, which patent is owned by the assignee of the present application. It can be appreciated that it would be desirable in a packaging system to have a means to facilitate placement of a sheet of material over an article grouping.

SUMMARY OF THE INVENTION

The present invention provides a flight bar and a system which facilitates synchronous movement of sheets of material with respect to respective article groupings and ultimately urges the sheets of material downwardly to juxtaposition over the article groupings. In a preferred embodiment of the invention a flight bar frame which translates along a predetermined path is adapted for engaging and translating an article grouping of one or more articles while simultaneously engaging and translating a sheet of material above the article grouping. Ultimately the sheet of material is urged downwardly into juxtaposition above the article grouping by means of a lowering guide. The flight bar frame is adapted for passage therethrough of the lowering guides as the flight bar continues to travel the predetermined path translating the article grouping and vertically juxtaposed sheet of material.

Other advantages and objects of the present invention will be apparent from the following description, the accompanying drawings, and the appended claims.

DETAILED DESCRIPTION OF THE PREFERRED EMBODIMENT

Figure 5:
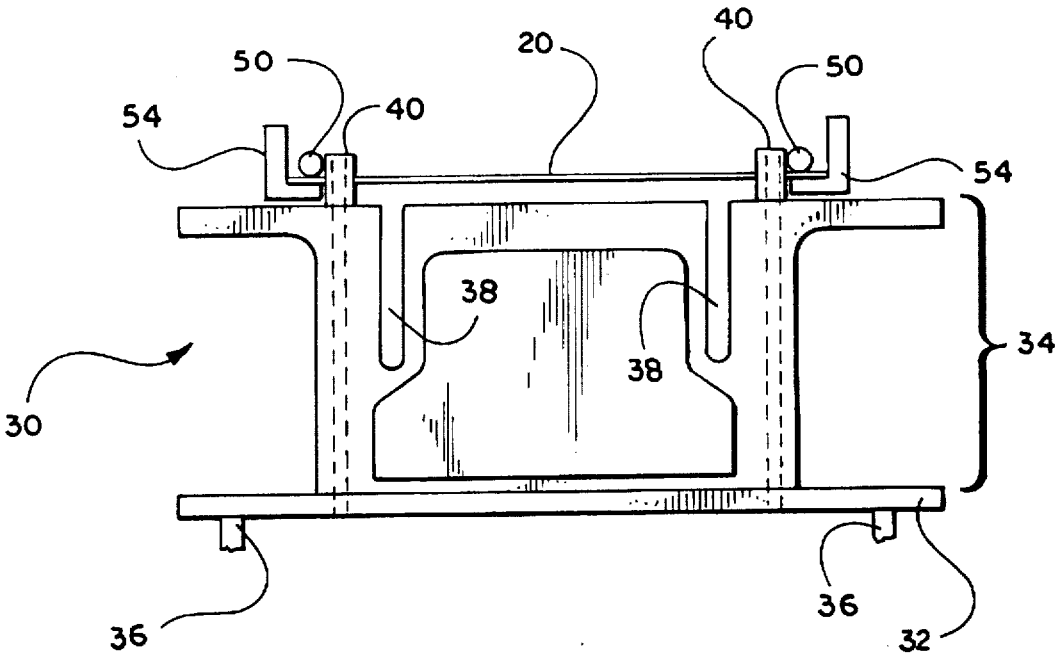
FIG. 5 is an elevational view of a schematic illustration of a packaging system and flight bar assembly according to a preferred embodiment of the invention.
Figure 7:
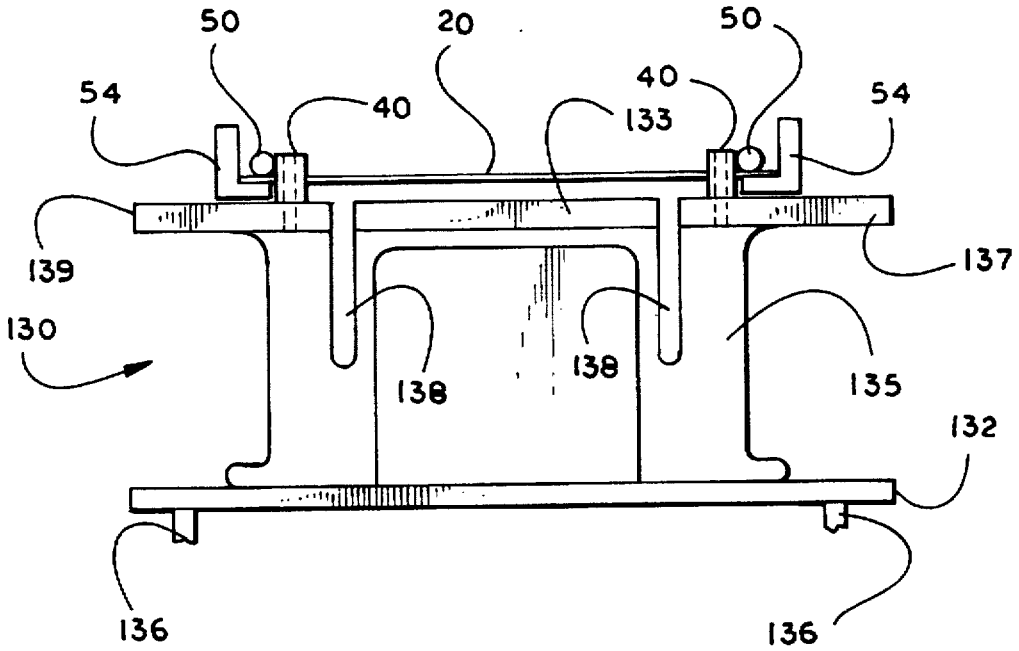
FIG. 7 is the same view as FIG. 5 with an alternate preferred embodiment of the flight bar assembly.

Throughout the drawings the same reference numerals are used to denote the same features except that in FIG. 7, with respect to an alternate embodiment of the flight bar assembly, the same numbers, but in a "100" series, are used to denote features similar or identical to those of FIG. 5.

Figure 2:
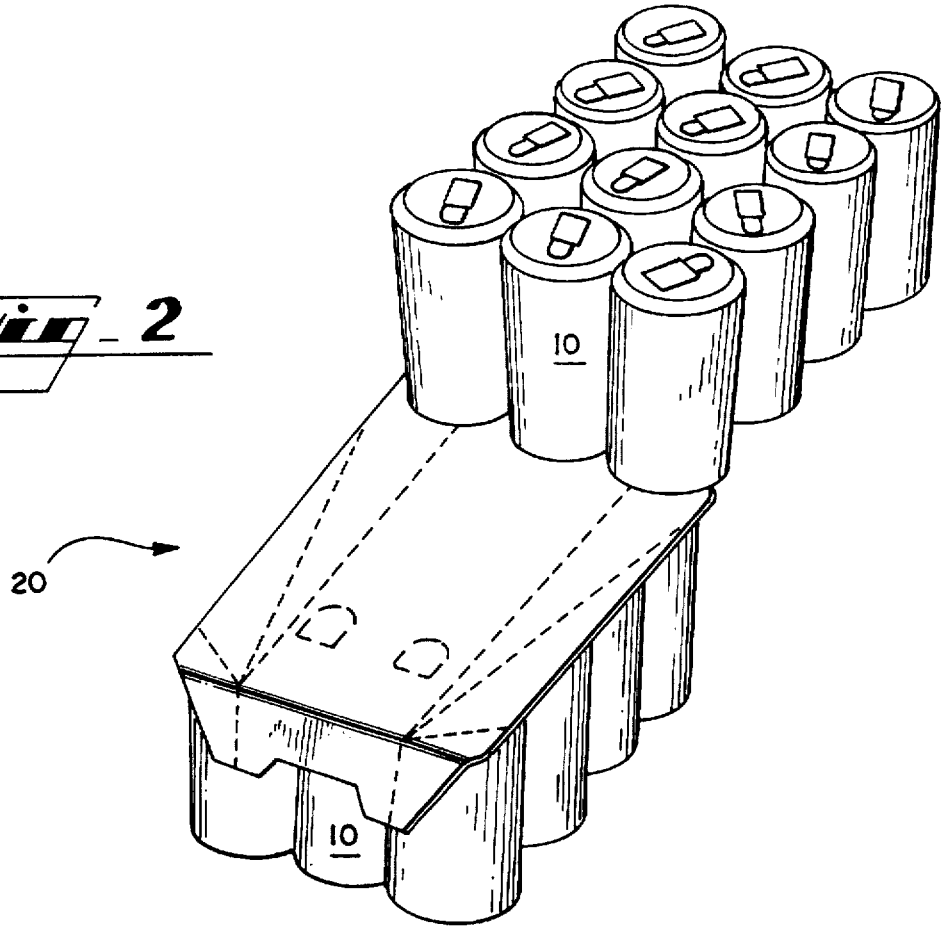
FIG. 2 is an isometric illustration of the insert sheet of FIG. 1 shown in use as a separator between two tiers of cans prior to full alignment of the upper tier of cans over the lower tier.
Figure 3:
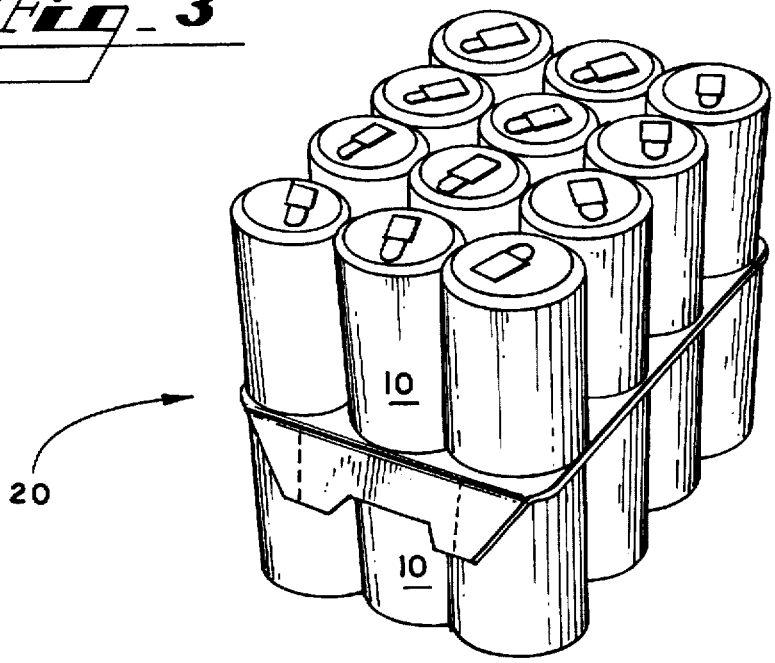
FIG. 3 is an isometric illustration of the insert sheet of FIG. 1 shown in use as a separator between two tiers of cans after full alignment of the upper tier of cans over the lower tier.
Figure 6:
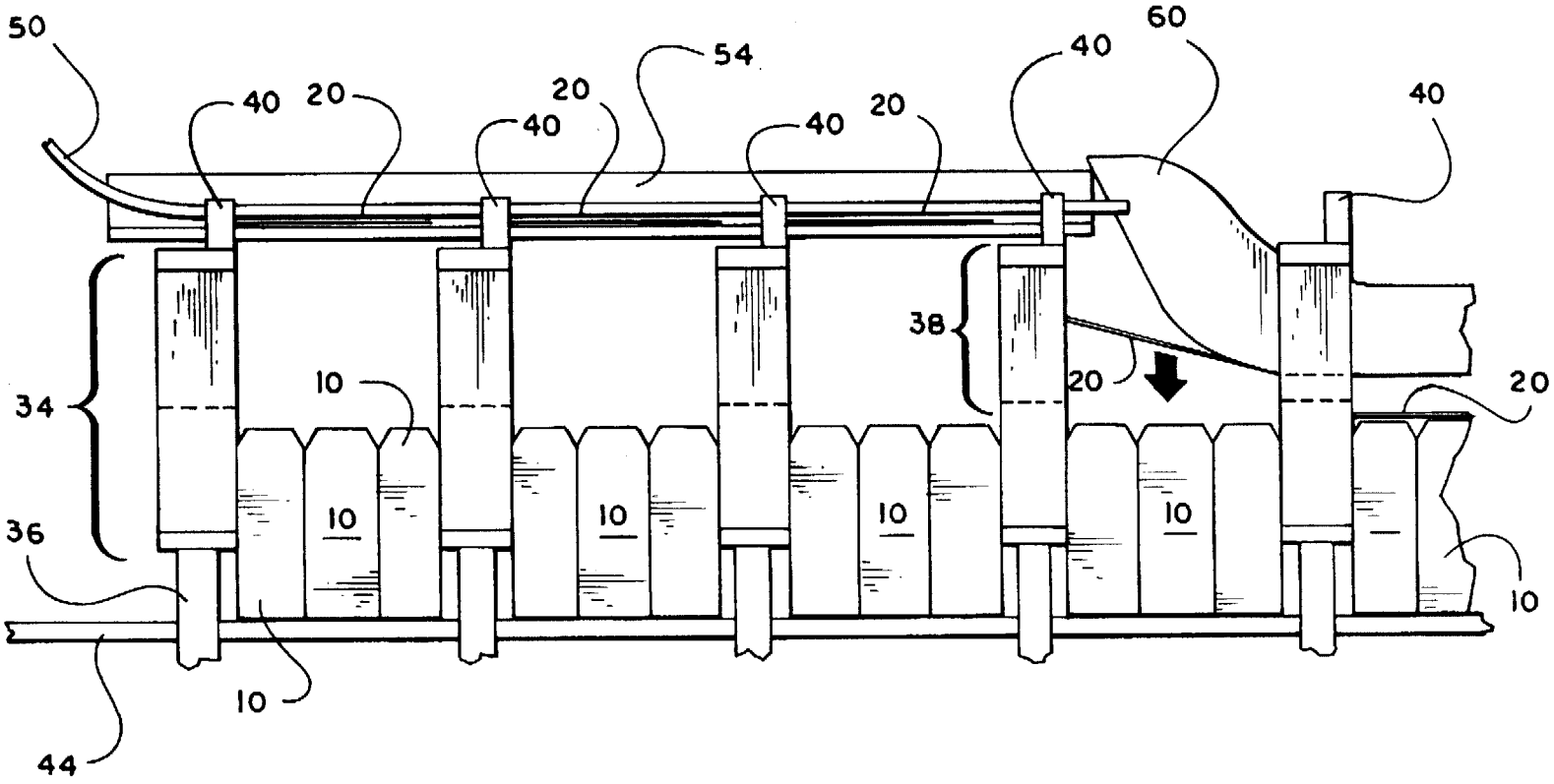
FIG. 6 is an elevational view from a side vantage point of a schematic illustration of a packaging system and flight bar assembly according to a preferred embodiment of the invention.

Referring first particularly but not exclusively to FIGS. 5 and 6, as an overview, a system according to a preferred embodiment of the present invention translates a sheet of material, such as the insert 20 illustrated in FIGS. 1–7, in synchronous motion over an article grouping, such as the array of cans 10 illustrated in FIGS. 2, 3, and 6. A guide urges the insert 20 downwardly while the insert 20 and article 10 grouping continues to be moved along by the flight bar assembly 30, 130. The fight bar assembly 30, 130 and the flight bar frame in particular, is adapted to accommodate the guide 60 which urges the insert downward.

Figure 1:
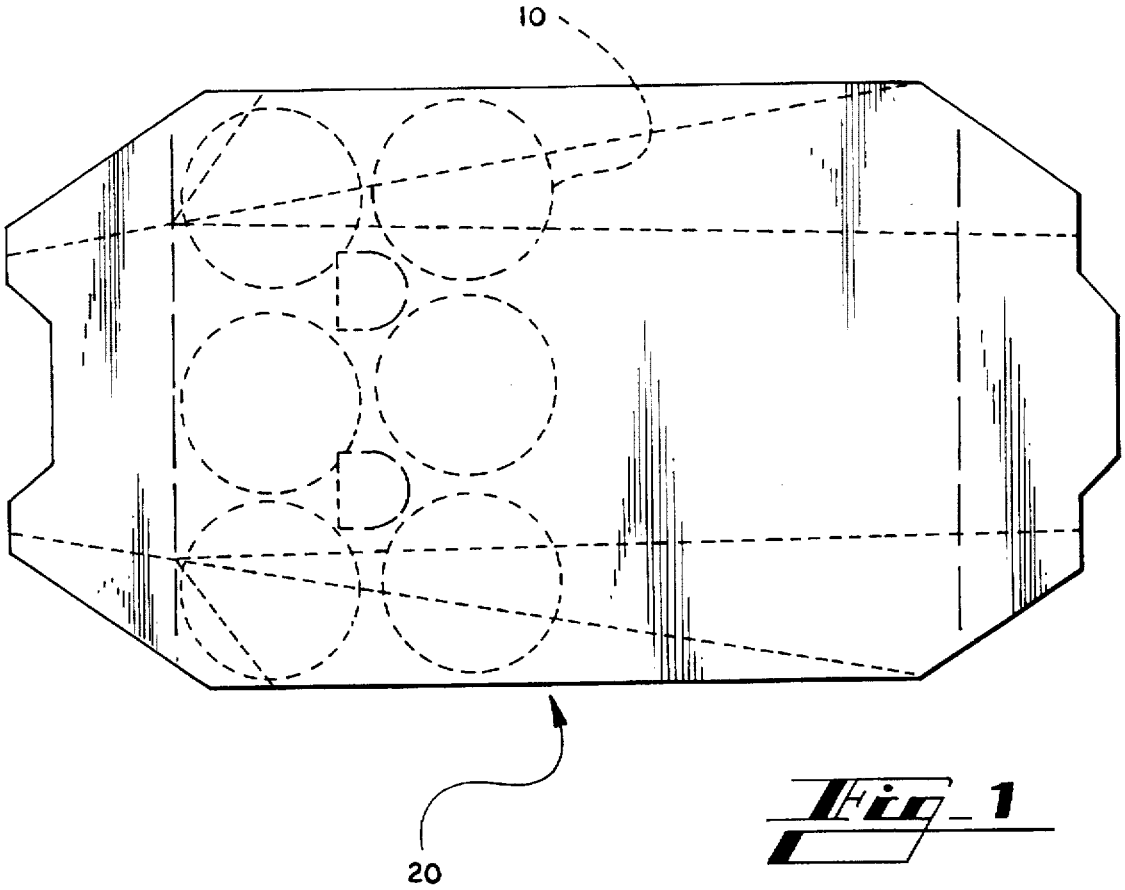
FIG. 1 is a plan view illustration of a packaging insert panel which is equivalent to a sheet of material suitable for handling by a preferred embodiment of the invention.
Figure 4:
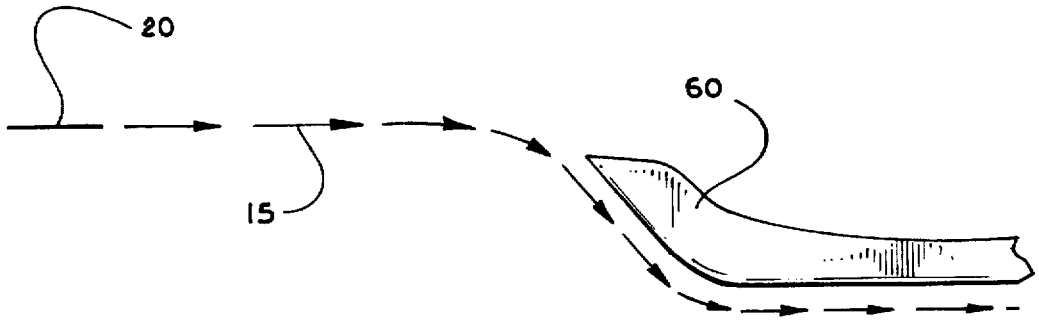
FIG. 4 is a schematic illustration of the path traveled by a sheet of material translated by a flight bar and flight bar system in accordance with the preferred embodiment of the invention.

Referring now particularly to FIG. 5, the flight bar assembly 30 of the preferred embodiment of the system has a lower flight member 32 which supports an upper flight bar member 34. The lower flight bar member 32 is, in turn, connected to trucks 36 or similar elements for movement by a conveyor or endless chain/belt, or other means for propulsion. The upper flight bar member 34 defines slots 38 for accommodating guides 60. The guides 60 will be explained in greater detail below. Projections, such as lugs 40, from the top of the upper flight bar member, are adapted for engaging and translating a sheet of material 20. A pathway for the sheets (inserts 20) is provided between two guides. For convenience of reference in describing the preferred embodiment these guides will be denoted the upper insert guide 50 and the lower insert guide 54. Reference is made now particularly to FIGS. 4 and 6 to direct attention to the lowering guide 60 which urges the inserts 20 downardly over the article (can) groupings. Although only a single lowering guide 60 is visible in the elevational view of FIG. 6, the invention contemplates that several guides 60 may be used in parallel combination to lower the inserts 20 in proper alignment with the article 10 groupings.

In a preferred method of operation of the system, article 10 groupings are generally moved along by the lower flight bar members 32 as generally depicted in FIG. 6. At the same time, inserts 20 are synchronously moved along above the article 10 groupings by the lugs 40, or members, projecting from the top of the upper flight bar member 34. The lowering guides 60 are disposed such that when a sheet 20 which is being pushed along by the lugs 40 leaves the pathway defined by the insert guides 50, 54, the sheet 20 is engaged by the lowering guide 60. The lowering guide 60 deflects the insert 20 downwardly (as indicated by the downwardly-pointing direction arrow) to a closer position over and with respect to the article 10 grouping. The slots 38 are positioned to allow unencumbered passage of the lowering guides 60 through the flight bar. The slots 38 are shown to extend upwardly through the top of the flight bar assembly frame. In the preferred embodiment, the flight bar assembly is mounted upon an endless chain or similar revolving, cyclical element known in the art. The described positioning of the slots 38 with respect to the top of the flight bar assembly permits free passage of the flight bar assembly 30 and lowering guide 60 with respect to one another when the flight bar assembly reaches the end of its coextensive path with the lowering guide members and travels the arc which takes it out of that path and into its return path to restart its cyclical run.

Referring now to FIG. 7, therein is illustrated an alternate embodiment of a flight bar assembly 130 according to a preferred embodiment of the invention. In the alternate embodiment the upper portion of the flight bar 130 is divided into an upstanding, intermediate flight bar member 135 and three top-most, or uppermost, flight bar members 133, 137, 139. The upright members have slots 138 which accommodate the lowering guides 60 in the manner described above. The uppermost flight bar flight bar members 133, 137, 139 are configured and attached to the intermediate flight bar member 135 in such a manner that the passageway provided by each slot 138 is maintained. The insert panel lugs 40 project from the uppermost flight bar members 133, 137, 139.

The alternate flight bar assembly 130 operates in the same manner as the previously described flight bar assembly 30. However, the additional benefit provided by the alternate flight bar assembly 130 is that multiple types of material may be used to construct the assembly 130. For example, the uppermost members 133, 137, 139 of the flight bar assembly of the alternate embodiment can be manufactured from metal, while the intermediate member 135 may be manufactured from plastic. Similarly, the manufacturing components of the structure may be reversed with the uppermost members 133, 137, 139 manufactured from plastic, and the intermediate member 135 manufactured from metal. Further, the combination of materials may simply be different types or grades of metal such as aluminum and steel. Use of different manufacturing materials can help effect a cost savings by using more costly materials only where necessary. The ability to use different materials may also allow for the production of lighter or heavier overall assemblies as may be desired.

Modifications may be made in the foregoing without departing from the scope and spirit of the claimed invention. For example, each lowering guide 60 is indicated as a vertically-oriented blade. However, other configurations, (such as a rod) or other orientations (such as angled) may also be used. In such cases, the slots 38, 138 would again have a matching accommodating configuration which permits unrestricted translation of the flight bar.

What is claimed is:

1. A system for depositing sheets of material in vertical juxtaposition with respect to article groupings of at least one article per group, the system comprising:

at least one flight bar assembly translating along a predetermined path, having a flight bar frame adapted for engaging and translating one of the article groupings, and having at least one lug member disposed for engaging and translating one of the sheets of material above said one of the article groupings;

a sheet guide defining a pathway along which the sheets may be translated by said at least one lug member in vertical juxtaposition with respect to respective article groupings translated by said flight bar frame; and a sheet lowering guide disposed for urging the sheets translated by said at least one lug member downwardly with respect to respective article groupings; and wherein said flight bar frame is adapted for cooperative non-engaging motion with respect to said sheet-lowering guide assembly.

2. The system of claim 1, said flight bar frame having a slot corresponding with and aligned for passage therethrough of guide members of said sheet lowering guide assembly.

3. A flight bar for translating an article grouping of at least one upstanding article along a predetermined path which predetermined path is parallel with at least one guide member which guide member is disposed for intersection with the flight bar, said flight bar comprising:

a flight bar frame adapted for translating the article grouping including at least one upstanding member and an upper bar member extending transversely from an upper region of said upstanding member and having a slot extending upwardly and terminating at an open uppermost surface of said flight bar frame disposed for passage therethrough of the at least one guide member.

4. The flight bar of claim 3, wherein said slot extends upwardly through a respective one of said upstanding members.

5. The flight bar of claim 3, said flight bar frame comprising a pair of upstanding members interconnected by said upper bar member, said slot extending upwardly through a respective one of said upstanding members.

6. The flight bar of claim 3, further comprising at least one lug member projecting from said flight bar frame disposed for engaging and translating a horizontally-oriented sheet of material disposed above the at least one upstanding article.

* * * * *